US010556786B2

(12) United States Patent
Chaparro

(10) Patent No.: US 10,556,786 B2
(45) Date of Patent: Feb. 11, 2020

(54) COLLAPSIBLE FUNNEL

(71) Applicant: Carlos M. Chaparro, El Paso, TX (US)

(72) Inventor: Carlos M. Chaparro, El Paso, TX (US)

( * ) Notice: Subject to any disclaimer, the term of this patent is extended or adjusted under 35 U.S.C. 154(b) by 0 days.

(21) Appl. No.: 15/997,811

(22) Filed: Jun. 5, 2018

(65) Prior Publication Data

US 2018/0346308 A1 Dec. 6, 2018

Related U.S. Application Data

(60) Provisional application No. 62/515,661, filed on Jun. 6, 2017, provisional application No. 62/680,626, filed on Jun. 5, 2018.

(51) Int. Cl.
*B67C 11/02* (2006.01)
*B65B 39/02* (2006.01)

(52) U.S. Cl.
CPC ..... *B67C 11/02* (2013.01); *B65B 39/02* (2013.01)

(58) Field of Classification Search
CPC ..... B67C 11/02; B67C 2011/20; B65B 39/02
USPC ..... 141/338, 340, 341, 108–109, 390, 312
See application file for complete search history.

(56) References Cited

U.S. PATENT DOCUMENTS 998,352 A * 7/1911 Kublin ..... B67C 11/02 141/300
1,209,051 A 12/1916 Shotwell
1,302,086 A * 4/1919 Pitlick ..... B67C 11/02 141/340
1,420,011 A * 6/1922 Abbott ..... B67C 11/02 141/338
1,484,357 A * 2/1924 Mullen ..... B01D 29/085 141/340
1,587,493 A * 6/1926 Bower ..... A47J 43/22 248/94
4,557,378 A 12/1985 Klebold
5,488,979 A * 2/1996 McKenzie ..... B65B 39/00 141/311 A
5,607,004 A * 3/1997 Cope ..... B67C 11/00 141/331
6,397,907 B1 6/2002 Heintz
7,635,013 B2 12/2009 Ballinger
7,886,782 B1 2/2011 Curtis
8,567,457 B2 10/2013 Polewarczyk
2009/0188583 A1* 7/2009 Noel ..... B67C 11/00 141/391
2011/0011488 A1* 1/2011 Sickler ..... B67C 11/02 141/1

* cited by examiner

*Primary Examiner* — Timothy P. Kelly

(74) *Attorney, Agent, or Firm* — Loza & Loza LLP; Kevin L. Soules

(57) ABSTRACT

A system, method, and apparatus comprise a funnel, at least one extendable arm affixed to the funnel, and at least one jam on an end of the at least one extendable arm wherein the jam is configured to hold the funnel in a container. The system, method and apparatus further comprise the funnel which cam comprises a collapsible funnel. Jaws can be formed on an end of the funnel. The embodiments include a scoop configured to measure and dispense a material. A spring can be configured in the at least one extendable arm.

11 Claims, 9 Drawing Sheets

COLLAPSIBLE FUNNEL

CROSS REFERENCE TO RELATED PATENT APPLICATIONS

This patent application claims the priority and benefit under 35 U.S.C. § 119(e) of U.S. Provisional Patent Application Ser. No. 62/515,661 filed Jun. 6, 2017, entitled "COLLAPSIBLE FUNNEL." U.S. Provisional Patent Application Ser. No. 61/515,661 is herein incorporated by reference in its entirety.

This patent application also claims the priority and benefit under 35 U.S.C. § 119(e) of U.S. Provisional Patent Application Ser. No. 62/680,626 filed Jun. 5, 2018, entitled "COLLAPSIBLE FUNNEL." U.S. Provisional Patent Application Ser. No. 62/680,626 is herein incorporated by reference in its entirety.

TECHNICAL FIELD

The present embodiments are generally related to methods, systems, and apparatuses for funnels. The embodiments further relate to methods and systems that facilitate scooping, pouring, and/or transferring liquids, powders, or other such substances. Embodiments are additionally related to integrated systems and methods for measuring powders, liquids, or other substances and then pouring such substances.

BACKGROUND

Common funnels are useful for pouring a liquid into a container. However, it is often necessary to carefully and conveniently measure a specific amount of a substance before it is transferred to a new container. For example, many substances are difficult to pour into a container that has small or narrow opening. Likewise, standard funnels are bulky and inconvenient to transport and store.

Accordingly, there is a need in the art for methods and systems that provide portable means for precisely measuring and transferring substances from one container to another.

SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is therefore one aspect of the disclosed embodiments to provide a funnel.

It is an aspect of the disclosed embodiments to provide a method and system for storing a funnel.

It is another aspect of the disclosed embodiments to provide a collapsible funnel.

It is another aspect of the disclosed embodiments to provide systems and methods that facilitate scooping, pouring, and/or transferring liquids, powders, or other such substances with a collapsible funnel.

It is yet another aspect of the embodiments to provide integrated systems and methods for measuring powders, liquids, or other substances and then pouring such substances.

The aforementioned aspects and other objectives and advantages can now be achieved as described herein. In embodiments disclosed herein, a system, method, and apparatus comprise a funnel, at least one extendable arm affixed to the funnel, and at least one jam on an end of the at least one extendable arm wherein the jam is configured to hold the funnel in a container. In an embodiment the at least one extendable arm comprises two extendable arms. In an embodiment, of the system the funnel further comprises a collapsible funnel. In an embodiment, the system comprises jaws formed on an end of the funnel. In an embodiment, the system comprises a scoop configured to measure and dispense a material. In an embodiment, the system comprises a spring configured in the at least one extendable arm. The system further comprises a folding covering enclosing the spring configured in the at least one extendable arm. In an embodiment, the system comprises a funnel case configured to house the funnel.

In another embodiment, an apparatus comprises a funnel, at least one extendable arm affixed to the funnel, and at least one jam on an end of the at least one extendable arm wherein the jam is configured to hold the funnel in a container. In an embodiment, the at least one extendable arm comprises two extendable arms. In an embodiment, the funnel further comprises a collapsible funnel. In an embodiment, the apparatus further comprises jaws formed on an end of the funnel. In an embodiment, the apparatus further comprises a scoop configured to measure and dispense a material. In an embodiment, the apparatus further comprises a spring configured in the at least one extendable arm. In an embodiment, the apparatus further comprises a folding covering enclosing the spring configured in the at least one extendable arm.

In yet another embodiment, a system comprises a funnel, at least one curved arm affixed to the funnel, and at least biasing connection between the curved arm and the funnel wherein the at least one curved arm is configured to hold the funnel in a container. In an embodiment the at least one curved arm comprises two curved arms. In an embodiment, the funnel further comprises a collapsible funnel. In an embodiment, the system comprises jaws formed on an end of the funnel. In an embodiment, the system comprises a scoop configured to measure and dispense a material.

BRIEF DESCRIPTION OF THE FIGURES

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

Figure 1:
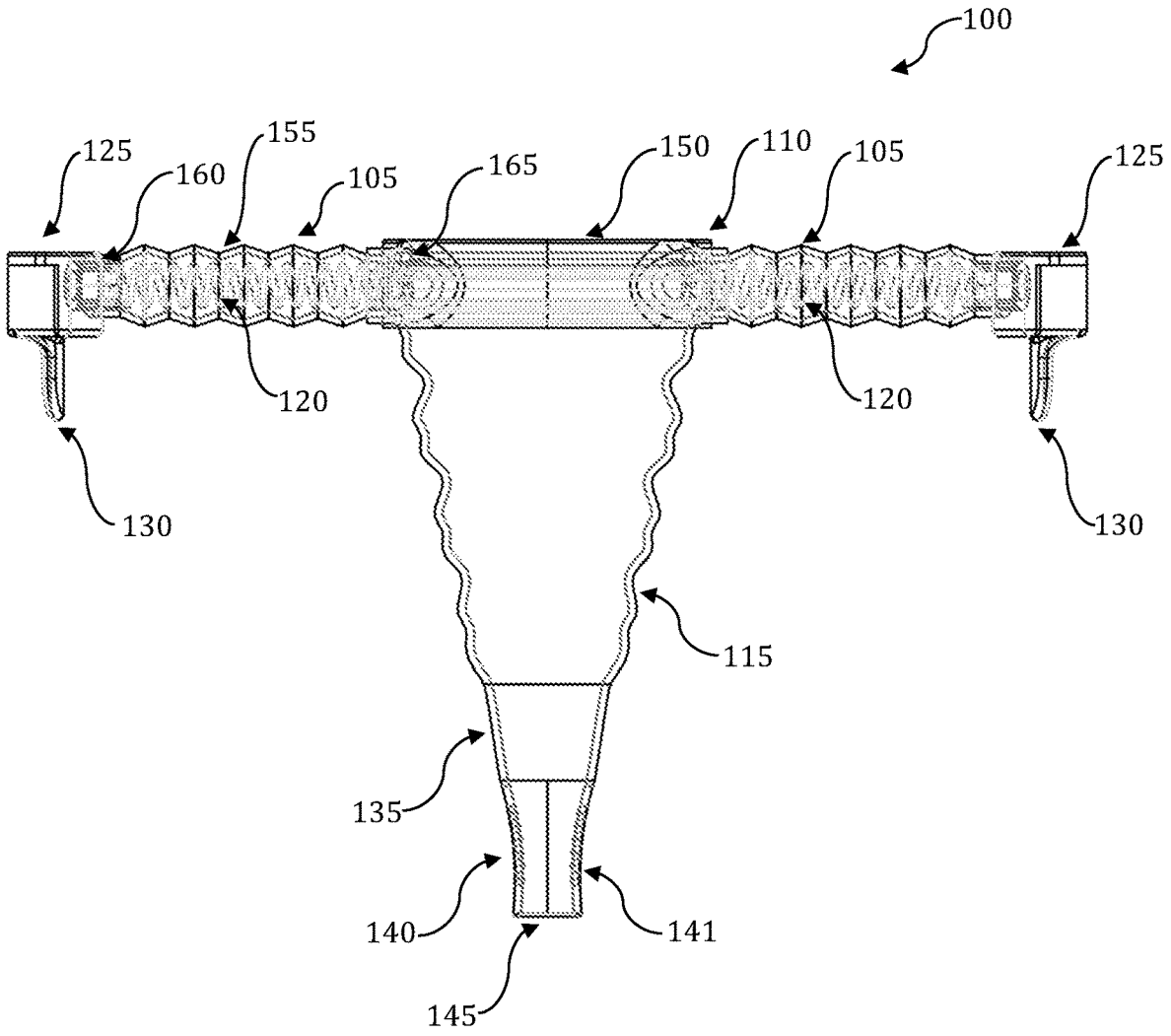
FIG. 1 depicts a funnel in accordance with the disclosed embodiments.

The particular values and configurations discussed in the following non-limiting examples can be varied, and are cited merely to illustrate one or more embodiments and are not intended to limit the scope thereof.

Example embodiments will now be described more fully hereinafter with reference to the accompanying drawings, in which illustrative embodiments are shown. The embodiments disclosed herein can be embodied in many different forms and should not be construed as limited to the embodiments set forth herein; rather, these embodiments are provided so that this disclosure will be thorough and complete, and will fully convey the scope of the embodiments to those skilled in the art. Like numbers refer to like elements throughout.

The terminology used herein is for the purpose of describing particular embodiments only and is not intended to be limiting. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

In general, terminology may be understood at least in part from usage in context. For example, terms such as "and," "or," or "and/or" as used herein may include a variety of meanings that may depend at least in part upon the context in which such terms are used. Typically, "or" if used to associate a list, such as A, B, or C, is intended to mean A, B, and C, here used in the inclusive sense, as well as A, B, or C, here used in the exclusive sense. In addition, the term "one or more" as used herein, depending at least in part upon context, may be used to describe any feature, structure, or characteristic in a singular sense or may be used to describe combinations of features, structures, or characteristics in a plural sense. In addition, the term "based on" may be understood as not necessarily intended to convey an exclusive set of factors and may, instead, allow for existence of additional factors not necessarily expressly described, again, depending at least in part on context.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

The embodiments disclosed herein are directed to methods and systems for measuring and transferring powders, liquids, and other materials from one container to another. In an exemplary embodiment, a collapsible funnel 100 is attached to one or more spring-loaded arms 105. The spring-loaded arms 105 are configured to engage with the inside of a container, or a container lid. The collapsible funnel 100 can thus be stored inside the container or container lid. When required, a user can easily free the funnel from its stored configuration by gently compressing the spring-loaded arms 105. The funnel 100 can then be used to transfer material and can then be replaced, in its stored configuration, in the container, or container lid.

FIG. 1 illustrates an embodiment of a collapsible funnel 100. The rim 110 of the funnel body 115 is configured with two spring-loaded arms 105. Each of arms 105 includes an internal spring 120 and external covering 155. The external covering 155 can comprise any compressible material such as plastic, polymer, rubber, silicone, or the like. Furthermore, the external covering 155 comprises alternating inwardly biased folds, and outwardly biased folds, forming an accordion type structure. The external covering 155 is thus configured to extend and contract with the spring-loaded arm 105 as the spring 120 is compressed or expanded.

The spring 120 in spring-loaded arm 105 is biased to hold the spring-loaded arms 105 in an extended position, as shown in FIG. 1. In certain embodiments, the spring-loaded arms 105 can be attached to a mounting ring 165. The distal end of the spring-loaded arm 105 can include an attachment cup 160. The spring 120 is held in the attachment cup 160, such that the spring 120 can be compressed between the mounting ring 165 and attachment cup 160.

The mounting ring 165 can have a diameter that is slightly smaller than the diameter of the top funnel rim 110. In such embodiments, the funnel can be removed from the mounting ring 165 and spring-loaded arm assembly for use. After the funnel is used, it can be replaced in the mounting ring 165. The funnel rim 110 can be held in place by the mounting ring 165.

The distal ends of the spring-loaded arms 105 are fitted with jams 125 which extended just beyond the attachment cups 160 so that the spring 120 is not exposed. The jams 125 are configured to butt up against a surface. The springs 120 serve to provide force such that the jams 125 hold the collapsible funnel 100 in place. The jams 125 can include extending lip 130. The extending lip 130 provides a surface for a user to grab and retract the spring-loaded arms 105, so that the collapsible funnel 100 can be inserted into, or removed from, a container.

Figure 2:
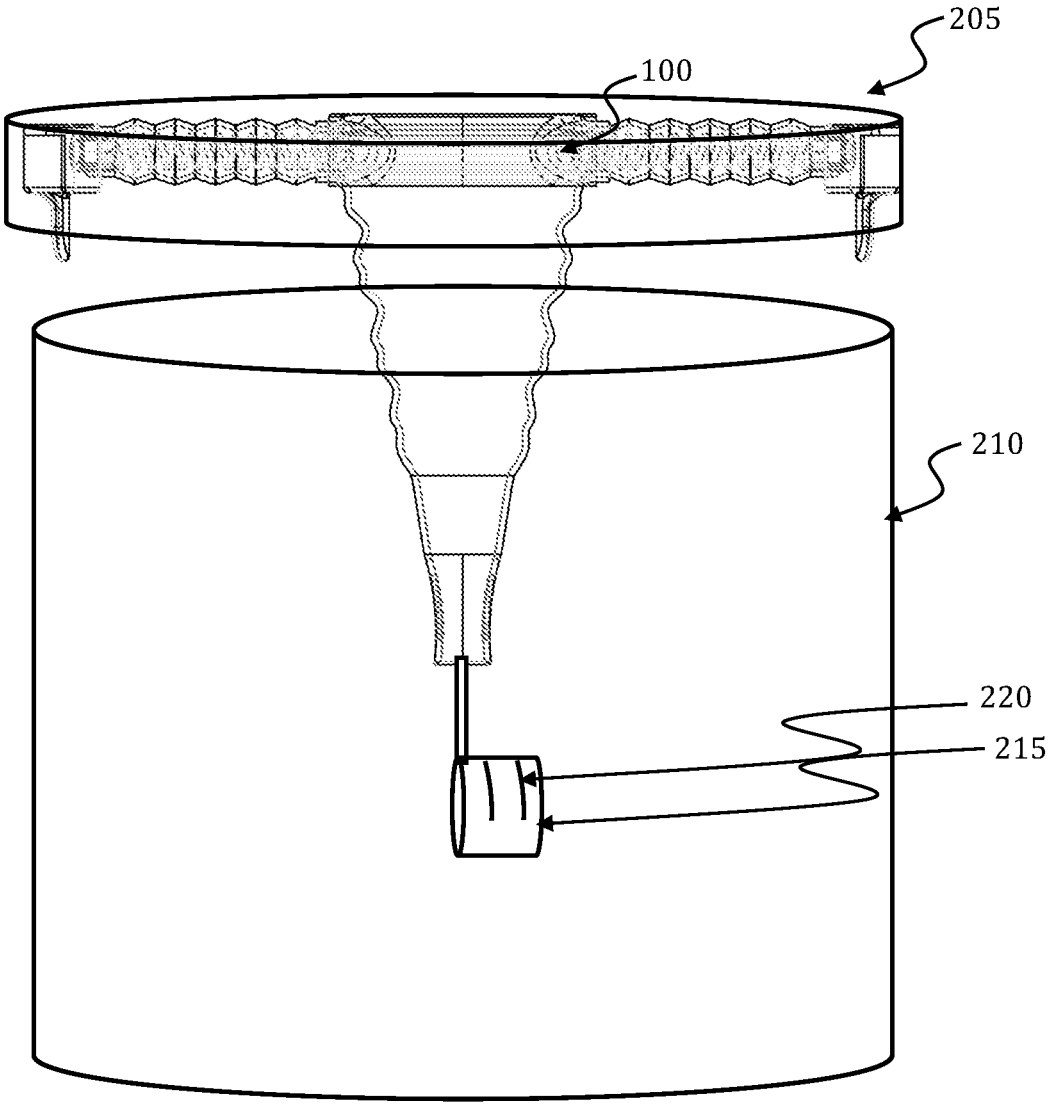
FIG. 2 depicts an embodiment of a funnel deployed in a container in accordance with the disclosed embodiments.

For example, in an exemplary embodiment, the spring-loaded arms 105 and jams 125 are configured to hold the collapsible funnel 100 in the lid 205, or rim, of a container 210. FIG. 2 illustrates jams 125 extended against the inner surface of lid 205. However, in some embodiments, the extendable arms 105 and jams 125 can press against the inner surface of container 210.

In certain embodiments, the funnel 100 is also configured to clasp a scoop 215. The bottom of the funnel body 115 can include funnel support 135 and jaws 140 and 141. The funnel support 135 can be made of a rigid or semi-rigid material and lends structural support 135 to the funnel body 115.

Jaws 140 and 141 can be configured to naturally engage against one another. However, jaws 140 and 141 can be separated so that a surface of, for example a scoop 215 (but other objects can be used) can be inserted there between. The jaws natural bias to the closed position thus holds the object in between jaw 140 and jaw 141. The natural bias of the jaws 140 and 141 to the closed position can be a result of their respective connection to the funnel support 135 which is fixedly connected to the the jaws 140 and 141.

It should be appreciated that each of jaw 140 and jaw 141 is configured to have matching and interfacing half-moon shaped profiles (or other such matching shaped profiles) so that opening 145 of funnel body 115 forms a tubular shaped conduit through which material can pass. Thus, when jaws 140 and 141 are in their naturally closed position, opening 145 allows a fluid, powder, or other material to flow through the top opening 150 of collapsible funnel 100 and out the bottom opening 145 of the collapsible funnel 100.

The object held between jaws 140 and 141 can be any object, such as, for example, a nutrition supplement scoop 215, that can be used to collect, and very precisely measure, the amount of liquid, powder, or other such material in the scoop 215.

The scoop 215 can be graduated with markings 220 on the interior or exterior surfaces of the scoop. The scoop 215 can be formed of a clear material to facilitate a determination of the level of the substance in the scoop. The scoop 215 is useful in preventing cross contamination while the funnel jaws 140 and 141 are useful in preventing loss of the scoop 215; both common problems with prior art scoops.

Figure 3A:
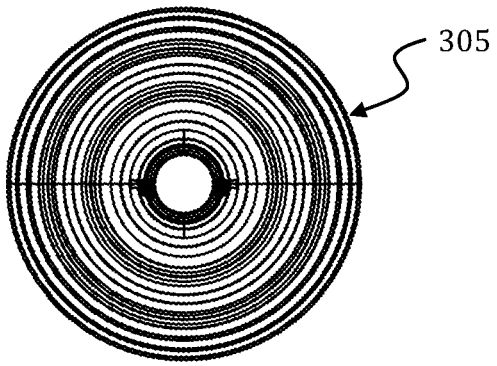
FIG. 3A depicts a top view of a funnel in accordance with the disclosed embodiments.
Figure 3B:
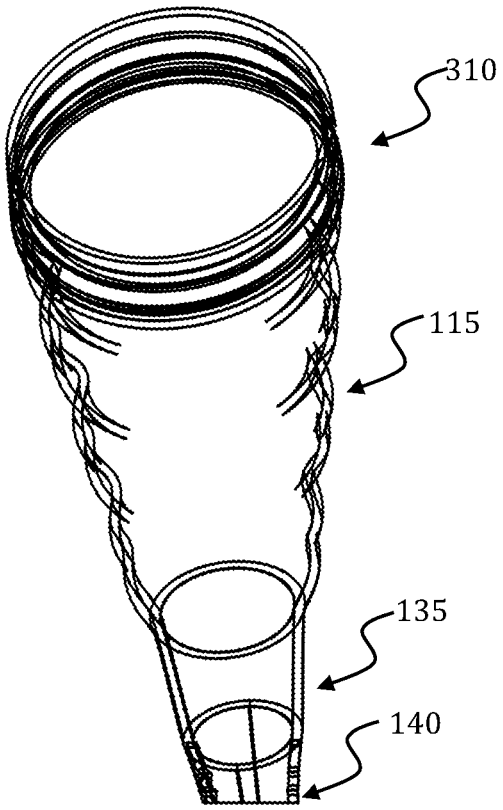
FIG. 3B depicts a side view of a funnel in accordance with the disclosed embodiments.

As illustrated in FIG. 3, the collapsible funnel 100, and in particular funnel body 115, can be collapsed into a virtually flat configuration 305. The uncollapsed configuration 310 illustrates that the funnel body 115 can comprise a series of sections, each with a decreasing diameter from the diameter of the preceding section closer to the top funnel opening. The funnel body 115 can be collapsed by pushing the bottom most section into the immediately preceding section, and repeating this operation for each section so that the funnel body 115 collapses in an accordion like manner. Similarly, the funnel can be extended into an un-collapsed state by pulling the bottom most section and/or jaws 140 and 141 down or away from rim 110.

Figure 4A:
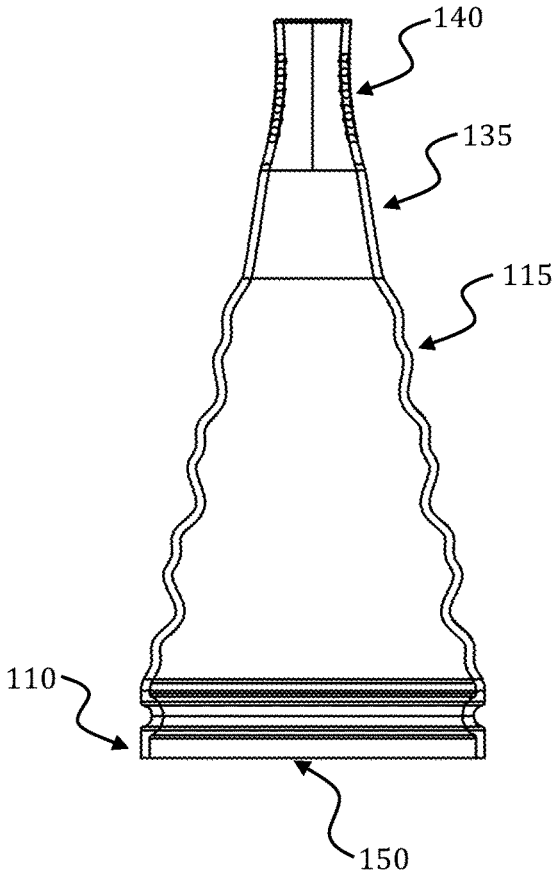
FIG. 4A depicts a side view of a funnel in accordance with the disclosed embodiments.
Figure 4B:
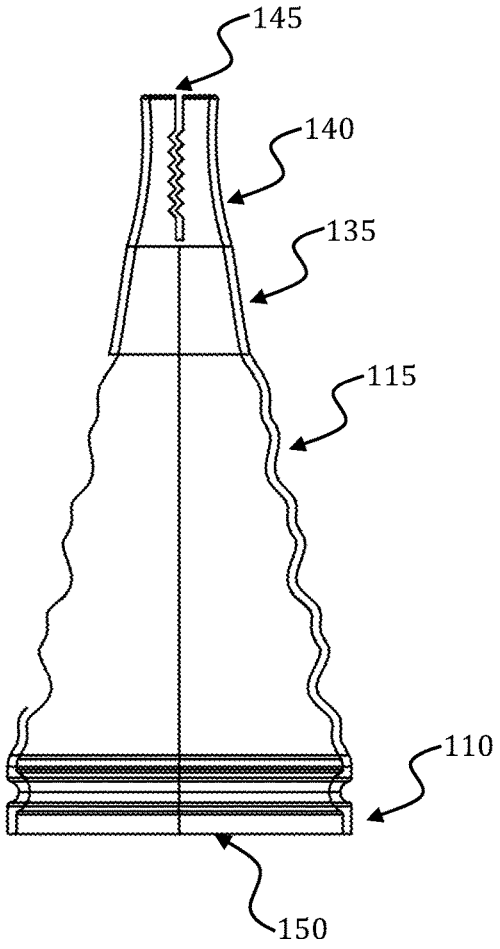
FIG. 4B depicts a side view of a funnel in accordance with the disclosed embodiments.

FIG. 4 illustrates funnel body 115 in an un-collapsed state. Of note, are jaws 140 and 141, which are closed in FIG. 4A and opened in FIG. 4B. FIG. 4 also illustrates the configuration of the funnel material in sections of decreasing diameter, which allows funnel body 115 to collapse. The funnel body 115 is preferably made of food grade silicon, rubber, plastic, or other such material. Such materials facilitate the reduction and extension of the funnel body 115 because they can be flexible.

Figure 5A:
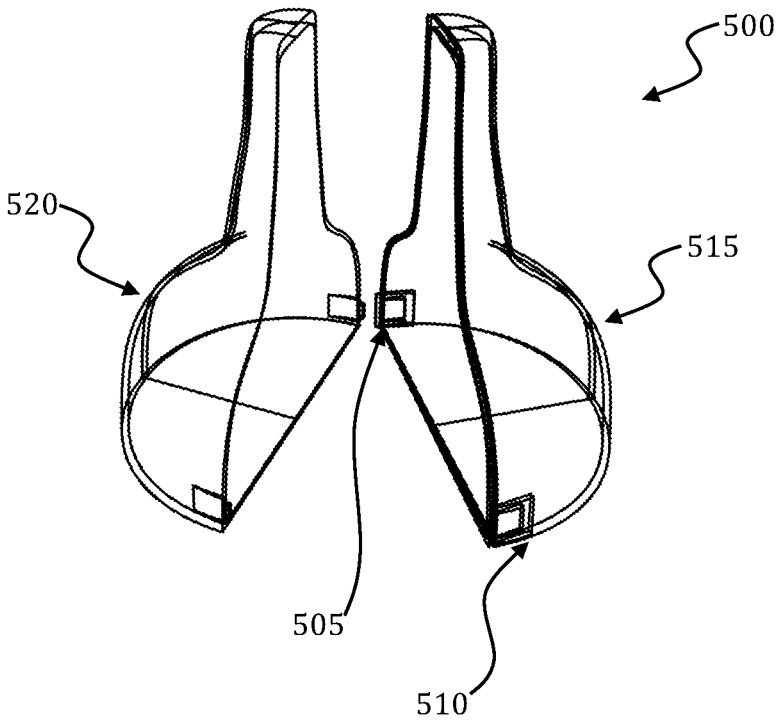
FIG. 5A depicts an enclosure for a scoop in accordance with the disclosed embodiments.
Figure 5B:
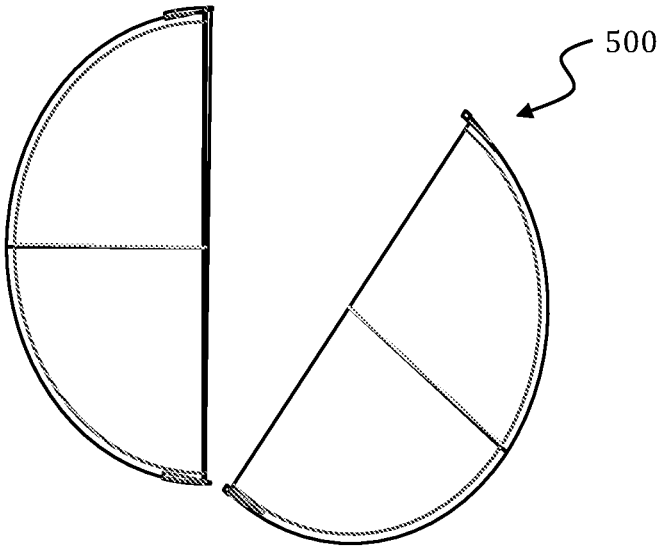
FIG. 5B depicts a top view of an enclosure for a scoop in accordance with the disclosed embodiments.

FIG. 5A and FIG. 5B illustrate funnel case 500. Funnel case 500 comprises hard shell half 515 and hard shell half 520, each of which is shaped to fit around collapsible funnel 100. The funnel case 500 can enclose the collapsible funnel 100 to ensure the collapsible funnel 100 remains sanitary. The funnel case 500 includes clasps 505 and 510 which can be joined to hold the case closed or manipulated to release the case.

It should be understood that, because the funnel is detachable and the arms are spring-loaded, the system can easily be interchanged between containers without having to detach the spring-loaded arms that hold the funnel in place.

The embodiments disclosed herein provide a unique body and compressed spring arm assembly that allow a funnel to be stored inside the lid of containers. In certain embodiments, the funnel can be wholly detached from the rim and spring arm assembly. Additionally, the present funnel design includes jaws (e.g. teeth) at the tip of the funnel, which are configured to hold a scoop from a supplement or a measuring scoop (or any other device) to be placed in the jaws and integrally stored. In the case of a scoop, this prevents the scoop from coming into contact with the supplement which decreases the chances of unwanted contamination, improves sanitation, and reduces the likelihood that the scoop is lost or buried inside of the material in the container.

Figure 6:
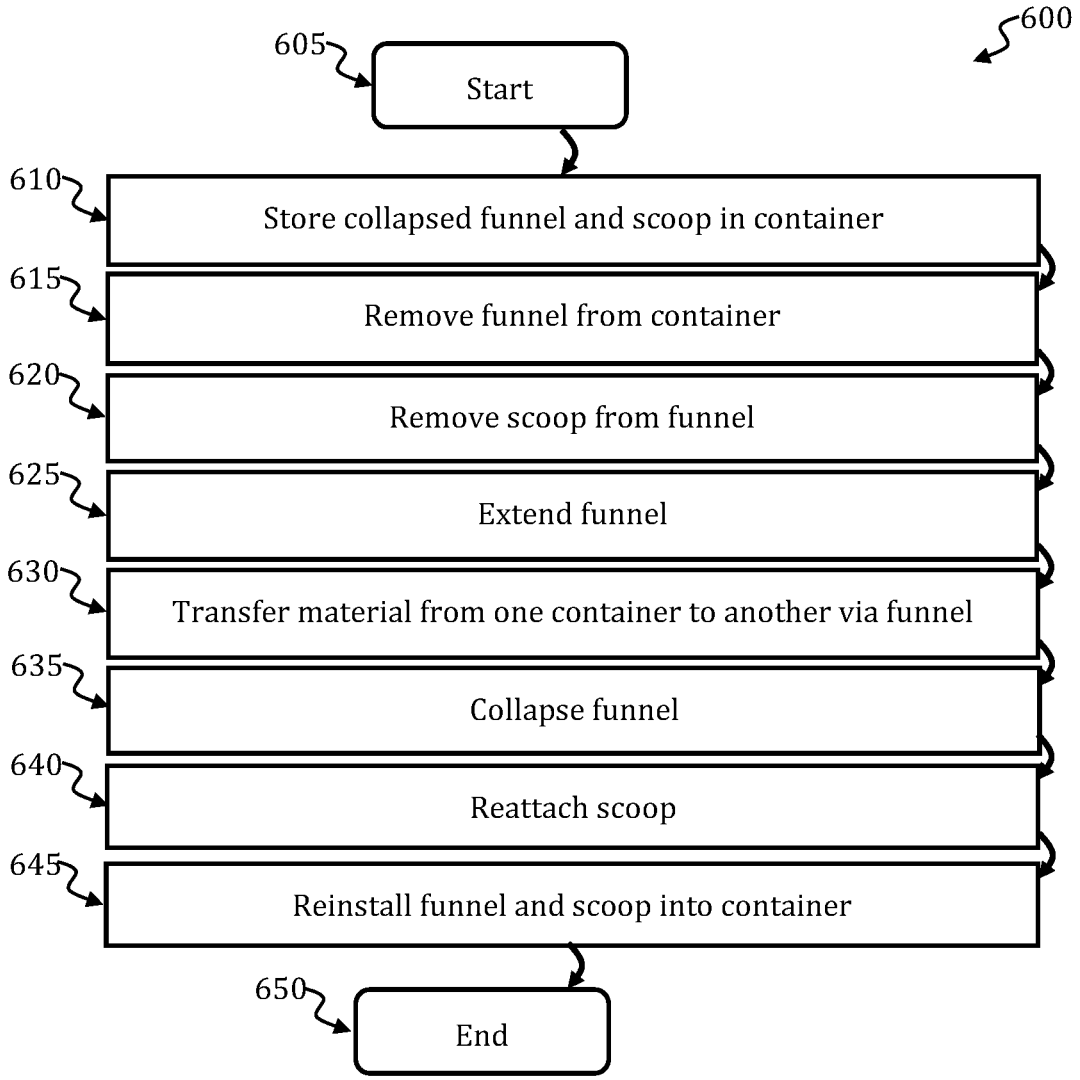
FIG. 6 depicts a flow chart illustrating steps associated with a method for using a funnel in accordance with the disclosed embodiments.

FIG. 6 illustrates a method 600 for transferring a material from one container to another. The method begins at step 605.

At step 610, the collapsible funnel assembly can be stored (or may already be stored) in a container. In some embodiments, the container may comprise a nutritional supplement container, but the funnel may be stored in any container. The spring-loaded arms, and jams associated with the funnel, span the diameter of the container. The springs in the spring-loaded arms exert outward force on the inner rim of the container or container lid, and hold the collapsible funnel in place in the container.

When a user requires the transfer of material from one container to another, the funnel can be removed from the container as shown at step 615. Removal of the funnel requires retraction of the spring-loaded arms via the finger grips provided on the jams. The scoop can also be removed from the jaws of the funnel as illustrated at step 620.

With the funnel removed from the container, the funnel can be extended, as shown by step 625, by pulling one end of the funnel away from the other. The funnel unfurls into a shape with a small diameter opening on one end and a large diameter opening on the other end. At this point, the funnel is ready for use. A material (most commonly a supplement scooped from the original container with the scoop, can be poured into the large diameter end of the funnel. The small diameter end of the funnel releases the material into the desired secondary container. The material is thus transferred from one container to another as illustrated at step 630. At this point, the funnel may optionally, or necessarily, be washed.

In order to store the funnel, it can, once again, be collapsed by pushing one end of the funnel toward the other, so that the small diameter sections nest inside the larger diameter sections as shown at step 635. The scoop can be reinserted into the funnel jaws as shown at step 640. Finally, the funnel can be reinstalled into a container at step 645 by retracting the arms and positioning them on the inner surface of the container. The jams contact the inner surface of the container and the funnel assembly is held in place via the pressure provided by the springs in the spring-loaded arms. The method ends at step 650.

Figure 7:
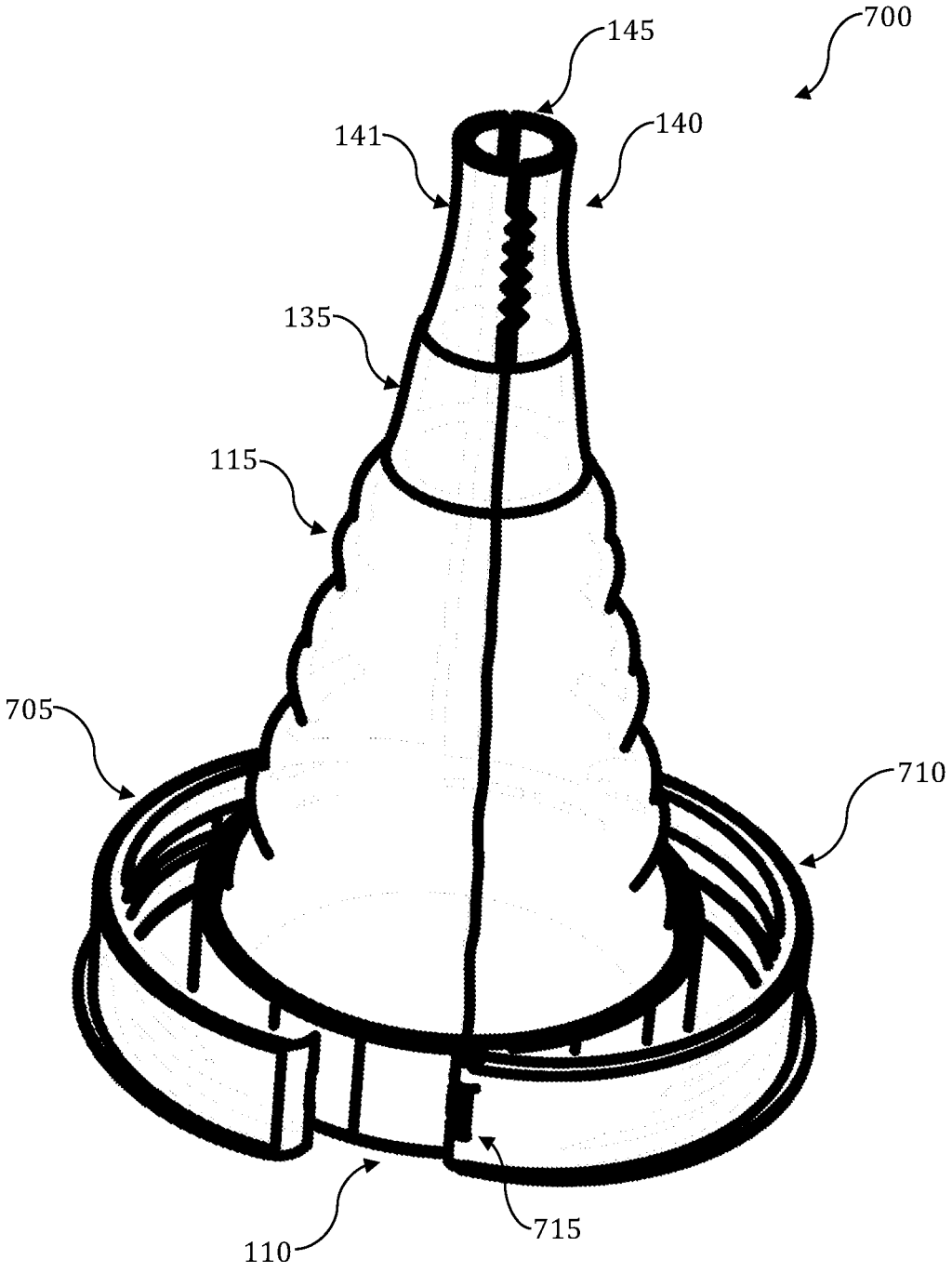
FIG. 7 depicts an embodiment of a funnel in accordance with the disclosed embodiments.

FIG. 7 illustrates another embodiment of a funnel 700. The funnel 700 includes a funnel body 115, connected to a funnel support 135, and funnel jaws 140 and 141, which form opening 145.

The funnel 700 includes two curved arms (additional curved arms could also be used). Curved arm 705 and curved arm 710 are provided to lodge the funnel in the opening of a container or container lid. The curved arms are connected to the funnel lip 110. The curved arm 710 is affixed to the funnel lip 110 with an attachment 715, that can comprise a spring, joint, or other such connection that naturally forces the curved arms 705 and 710 away from the funnel lip 110. The curved arms 705 and 710 can be used to exert an outward force against the inner surface of a container or container lid in order to hold the funnel 700 in the container.

Figure 8A:
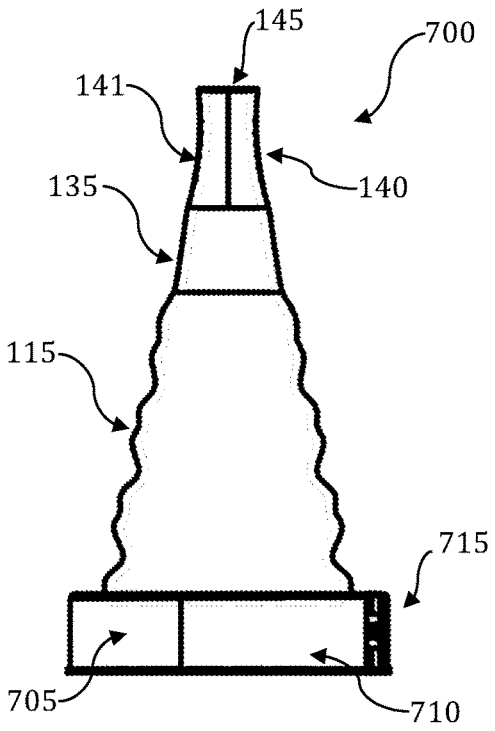
FIG. 8A depicts a side view of a funnel in accordance with the disclosed embodiments.
Figure 8B:
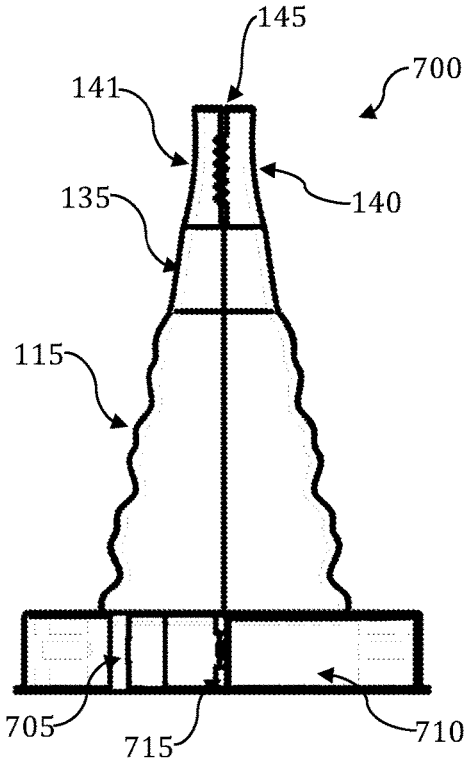
FIG. 8B depicts a side view of a funnel in accordance with the disclosed embodiments.

FIG. 8A and FIG. 8B illustrate funnel body 115 in an un-collapsed state. Of note, are jaws 140 and 141, which are closed in FIG. 8A and opened in FIG. 8B. FIG. 8A and FIG. 8B also illustrate the configuration of the funnel material in sections of decreasing diameter that allows funnel body 115 to collapse. The funnel body is preferably made of food grade silicon, rubber, plastic, or other such material. Such materials facilitate the reduction and extension of the funnel body 115 because they can be flexible.

Figure 9:
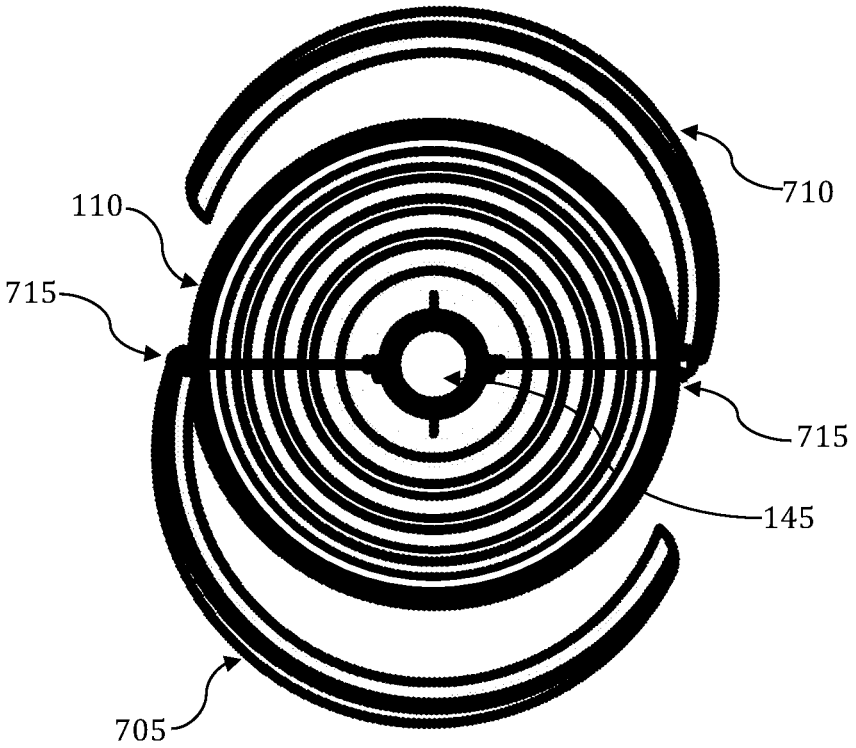
FIG. 9 depicts a top view of a funnel in accordance with the disclosed embodiments.

FIG. 9 illustrates, the collapsible funnel 700, and in particular funnel body 115, which can be collapsed into a virtually flat configuration. The uncollapsed configuration, shown in FIG. 8A and FIG. 8B, illustrates that the funnel body 115 can comprise a series of sections, each with a decreasing diameter from the diameter of the preceding section closer to the top funnel opening. The funnel body 115 can be collapsed by pushing the bottom most section into the immediately preceding section, and repeating this operation for each section so that the funnel body 115 collapses in an accordion like manner. Similarly, the funnel can be extended into an un-collapsed state by pulling the bottom most section and/or jaws 140 and 141 down or away from rim 110.

The aims of the embodiments disclosed herein are extensive. For example, some embodiments provide a portable funnel that is convenient to use and easy to store. Further, certain embodiments provide a way to store a measuring scoop and a funnel in one easy to use and convenient assembly. The embodiments include a means for storing the apparatus inside of storage containers. The funnel is collapsible to provide storage while in the container. The embodiments include a way to store a measuring scoop to prevent contamination of liquids or powders.

In certain embodiments, it may be useful to use the spring-loaded arms, or curved arms, to hold the funnel in a desired position above a container into which material will be transferred. In such embodiments, the jams on the spring-loaded arms, or curved arms, can be held against any two external objects such that the funnel is suspended above the container. This allows a user the freedom to use both hands in delivering the material into the funnel. The suspended funnel then directs the material into the desired container.

The ability to keep the measuring scoop uncontaminated addresses an important need in the art. The embodiments provide for complete isolation of the measuring scoop from other substances. The funnel and grip components of the embodiments can be made of food grade silicon and plastic (or other similar materials) to facilitate the dispensation of powders and liquids with out sticking. This helps prevent contamination of the liquid or powders. The springs can be coated with food grade standard material and secured so that the springs do not become a choking hazard. In certain cases, silicon is preferable because it allows funnel components to collapse without causing deterioration while providing enough grip at the tip of the funnel to allow the jaws to hold the scoop or measuring apparatus.

The invention further address an unmet need associated with funnels in general. It is common to need a funnel when transferring material. The disclosed embodiments provide a collapsible funnel that is stored in the container while preventing the funnel from being contaminated by external contaminants The collapsible funnel is thus unique in its simplicity, lowers the risk of substance contamination, and is both efficient and convenient to transport.

It will be appreciated that variations of the above-disclosed and other features and functions, or alternatives thereof, may be desirably combined into many other different systems or applications. For example, in an embodiment a system comprises a funnel, at least one extendable arm affixed to the funnel, and at least one jam on an end of the at least one extendable arm wherein the jam is configured to hold the funnel in a container. In an embodiment, the at least one extendable arm comprises two extendable arms.

In an embodiment of the system, the funnel further comprises a collapsible funnel. In an embodiment the system comprises jaws formed on an end of the funnel. In an embodiment the system comprises a scoop configured to measure and dispense a material.

In an embodiment, the system comprises a spring configured in the at least one extendable arm. The system further comprises a folding covering enclosing the spring configured in the at least one extendable arm.

In an embodiment, the system comprises a funnel case configured to house the funnel.

In another embodiment, an apparatus comprises a funnel, at least one extendable arm affixed to the funnel, and at least one jam on an end of the at least one extendable arm wherein the jam is configured to hold the funnel in a container. In an embodiment the at least one extendable arm comprises two extendable arms.

In an embodiment, the funnel further comprises a collapsible funnel. In an embodiment, the apparatus further comprises jaws formed on an end of the funnel. In an embodiment, the apparatus further comprises a scoop configured to measure and dispense a material.

In an embodiment, the apparatus further comprises a spring configured in the at least one extendable arm. In an embodiment, the apparatus further comprises a folding covering enclosing the spring configured in the at least one extendable arm.

In yet another embodiment, a system comprises a funnel, at least one curved arm affixed to the funnel, and at least biasing connection between the curved arm and the funnel wherein the at least one curved arm is configured to hold the funnel in a container. In an embodiment the at least one curved arm comprises two curved arms.

In an embodiment, the funnel further comprises a collapsible funnel. In an embodiment the system comprises jaws formed on an end of the funnel. In an embodiment the system comprises a scoop configured to measure and dispense a material.

It will be appreciated that variations of the above-disclosed and other features and functions, or alternatives thereof, may be desirably combined into many other different systems or applications. Also, it should be understood that various presently unforeseen or unanticipated alternatives, modifications, variations or improvements therein may be subsequently made by those skilled in the art which are also intended to be encompassed by the following claims.

What is claimed is:

1. A system comprising:

a funnel;

at least one extendable arm affixed to said funnel;

at least one jam on an end of said at least one extendable arm wherein said jam is configured to hold said funnel in a container;

a spring configured in said at least one extendable arm; and a folding covering enclosing said spring configured in said at least one extendable arm.

2. The system of claim 1 wherein said at least one extendable arm comprises two extendable arms.

3. The system of claim 1 wherein said funnel further comprises:

a collapsible funnel.

4. The system of claim 1 further comprising:

jaws formed on an end of said funnel.

5. The system of claim 4 further comprising:

a scoop configured to measure and dispense a material.

6. The system of claim 1 further comprising:

a funnel case configured to house said funnel.

7. An apparatus comprising:

a funnel;

at least one extendable arm affixed to said funnel;

at least one jam on an end of said at least one extendable arm wherein said jam is configured to hold said funnel in a container;

a spring configured in said at least one extendable arm; and a folding covering enclosing said spring configured in said at least one extendable arm.

8. The apparatus of claim 7 wherein said at least one extendable arm comprises two extendable arms.

9. The apparatus of claim 7 wherein said funnel further comprises:

a collapsible funnel.

10. The apparatus of claim 7 further comprising:

jaws formed on an end of said funnel.

11. The apparatus of claim 10 further comprising:

a scoop configured to measure and dispense a material.

* * * * *